United States Patent [19]

Guile

[11] 4,379,679

[45] Apr. 12, 1983

[54] SUPERSONIC/SUPERSONIC FLUID EJECTOR

[75] Inventor: Roy N. Guile, Wethersfield, Conn.

[73] Assignee: United Technologies Corporation, Hartford, Conn.

[21] Appl. No.: 211,613

[22] Filed: Dec. 1, 1980

[51] Int. Cl.[3] ..... F04F 5/46

[52] U.S. Cl. ..... 417/54; 417/179; 417/196

[58] Field of Search ..... 417/53, 54, 151, 179, 417/180, 196, 198

[56] References Cited

U.S. PATENT DOCUMENTS

| | | | |
|---|---|---|---|
| 631,007 | 8/1899 | Farrar | 417/179 |
| 1,001,154 | 8/1911 | LeBlanc | 417/179 X |
| 1,443,315 | 1/1923 | Ehrhart | 417/179 X |
| 1,543,834 | 6/1925 | Ehrhart | 417/179 X |
| 1,549,353 | 8/1925 | Ehrhart | 417/179 X |
| 4,332,529 | 6/1982 | Alperin | 417/179 |

FOREIGN PATENT DOCUMENTS

| | | | |
|---|---|---|---|
| 12796 | of 1892 | United Kingdom | 417/180 |
| 203139 | 12/1967 | U.S.S.R. | 417/197 |

OTHER PUBLICATIONS

"A Preliminary Investigation of Methods for Improving the Pressure-Recovery Characteristics of Variable-Geometry Supersonic-Subsonic Diffuser Systems", NACA Research Memorandum of Oct. 16, 1957, by Hasel and Sinclair.

*Primary Examiner*—Edward K. Look
*Attorney, Agent, or Firm*—Robert C. Walker

[57] ABSTRACT

An ejector for pumping a low pressure, supersonic driven stream to a high pressure is disclosed. Effective pressure recovery in a relatively short axial length is sought.

The low pressure driven stream is flowed at supersonic velocities into the ejector. A high energy driving stream is flowed laterally of the driven stream at a supersonic velocity greater than the supersonic velocity of the driven stream and a static pressure above the static pressure of the driven stream to cause compression of the driven stream at supersonic velocities.

4 Claims, 4 Drawing Figures

SUPERSONIC/SUPERSONIC FLUID EJECTOR

The Government has rights in this invention pursuant to Contract No. DAAHO1-76-C-1032 awarded by the Department of the Army.

DESCRIPTION

1. Technical Field

This invention relates to fluid ejectors, and more specifically to ejectors for pumping a supersonic gaseous medium to a higher pressure.

The concepts were developed in the laser industry for pumping a low pressure, supersonic lasing medium to atmospheric pressure, but have wide applicability to gas pumping ejectors in general.

2. Background Art

Ejector technology has been utilized in a plethora of pumping applications, both with liquid and gaseous mediums to be pumped. In principle all concepts employ increases in stream momentum as a higher energy, driving fluid is mixed with a lower energy, driven fluid.

In the chemical laser field in which the present concepts arose, ejectors have been historically used to pump a lasing medium from the optical cavity of the laser to the ambient atmosphere. Ejectors are well suited to this application in which the lasing medium is at a low static pressure, on the order of ten (10) to twenty (20) torr, and is traveling at high velocities, on the order of Mach two (2) to five (5).

Laser ejectors previously utilized have been of the supersonic/subsonic type in which a supersonic driving fluid, such as steam, pumps a subsonic lasing medium, such as the effluent of a deuterium/fluoride (DF) laser. In such an apparatus the lasing medium from the optical cavity is first decelerated in a supersonic diffuser to render the medium subsonic and then is pumped through the ejector. Although aerodynamically efficient, supersonic diffusers capable of efficiently decelerating a lasing medium from high Mach numbers to subsonic conditions tend to be quite long and are not suitable for many space limited applications. For portable lasers in particular, ejectors must not only be capable of effectively pumping low pressure lasing mediums, but must be of shortened axial length as well.

The first known study of related technical concepts is reported in the NACA Research Memorandum of Oct. 16, 1957 entitled "A Preliminary Investigation of Methods for Improving the Pressure-Recovery Characteristics of Variable-Geometry Supersonic-Subsonic Diffuser Systems" by Lowell E. Hasel and Archibald R. Sinclair. The NACA reported concepts involve the pumping of air with air and do differ technically from those of the present invention. As reported at page 1 of the study, a variable geometry mixer was employed in conjunction with an inclined driving fluid injector designed to provide driving fluid at a supersonic Mach number. The Mach number of the driving fluid is substantially less than the Mach number of the driven fluid.

In the period of time since the NACA Research Memorandum, scientists and engineers have utilized ejectors for laser pumping, and most recently have investigated modifications and improvements rendering the concepts more suitable for utilization as a laser ejector in space limited applications.

DISCLOSURE OF INVENTION

According to the present invention a supersonic driven medium is pumped to a higher pressure at supersonic velocities in an ejector employing compression across a multiplicity of weak, oblique shock waves as a driving fluid is flowed parallel to and laterally of the driven medium at a supersonic velocity greater than that of the driven medium and at a static pressure above the static pressure of the driven medium.

According to specific embodiments of the invention, the driving medium is injected through a plurality of laterally staged nozzles each of which is capable of discharging the driving medium flowing therethrough at a higher static pressure than the inwardly adjacent medium to enable the generation of a large number of weak shock waves over a short axial length.

A primary feature of the present invention is aerodynamic compression of the driven stream at supersonic velocities. A supersonic driving fluid medium is discharged laterally of the supersonic driven fluid medium at a higher static pressure than the static pressure of the driven medium to effect compression of the driven fluid. The supersonic driving fluid is discharged through one or more ejector nozzles laterally of the passage through which the driven fluid is delivered to the ejector. The walls of the mixing/compression section of the ejector converge through the section to maintain a uniform static pressure at the wall adjacent to the driving fluid as the driven fluid is compacted and compressed. Supersonic mixed flow is shocked to subsonic conditions in a throat section downstream of the supersonic diffuser and is diffused subsonically to the atmosphere in the divergent walled duct downstream of the throat section. Mixing of the driving and driven fluids predominantly occurs downstream of the driven medium compression in the throat section.

A principal advantage of the present invention is the enhanced capability for pressure recovery in a relatively short-length structure. The need for long supersonic diffuser, comprising a convergent-walled duct and throat section, upstream of the ejector for diffusion of supersonic flow to subsonic conditions is eliminated. The driven medium is compacted and compressed across weak oblique shocks which are generated in the driven medium. Boundary layer separation is discouraged through the aerodynamic effect of a higher velocity driving stream on the lower velocity driven stream. In some embodiments, a large number of weak shock waves are generated in a short axial length through utilization of a plurality of laterally staged driving medium nozzles. The driving medium discharged from each successively lateral stage is at a higher static pressure than the next inward stage.

The foregoing, and other objects, features and advantages of the present invention will become more apparent in the light of the following detailed description of the preferred embodiment thereof as shown in the accompanying drawing.

BEST MODE FOR CARRYING OUT THE INVENTION

Figure 1:
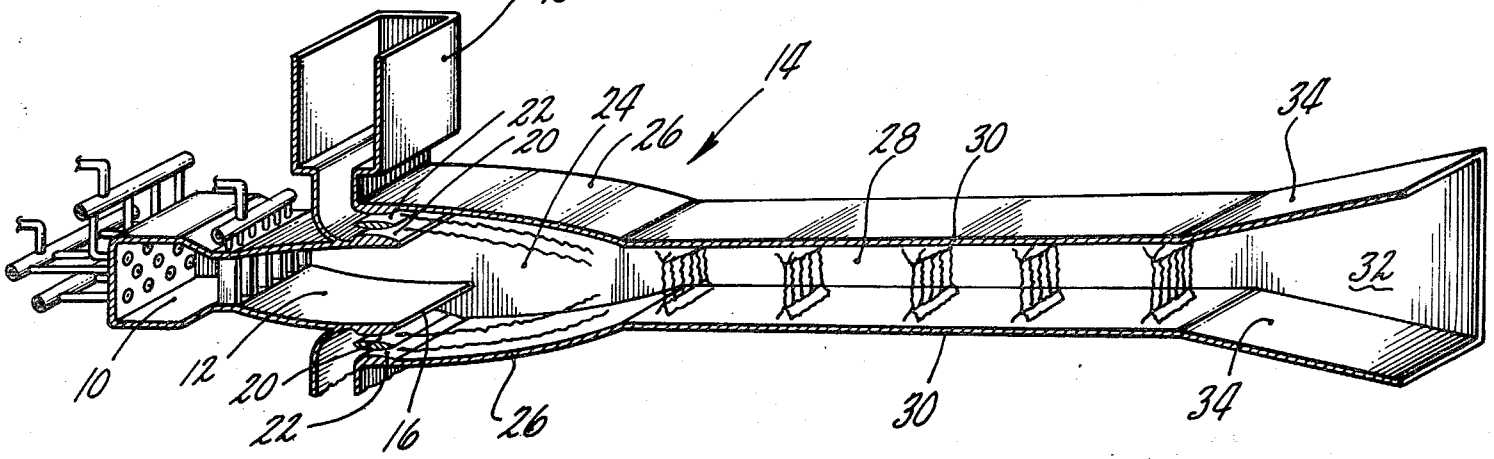
FIG. 1 is a simplified cross section view in perspective showing a laser embodiment of the present invention.

The concepts of the present invention are described in conjunction with a deuterium/fluoride (DF) chemical laser and are illustrated in the FIG. 1 perspective cross section view of such a laser. The laser principally includes a combustor 10 for generating fluorine atoms (F) and an optical cavity 12 into which deuterium ($D_2$) is injected to create the excited molecules of a lasing specie by reaction with the fluorine atoms. The laser beam is formed across the optical cavity. The lasing specie in this case excited deuterium/fluoride molecules (DF*), is typically flowed at high velocity across the optical cavity in order to bring the specie in the path of the generated beam before the molecules revert to an unexcited state. Mach numbers on the order of two (2) are representative for deuterium/fluoride (DF) lasers.

Low pressures and supersonic velocities are required for proper operation of such lasers. Effective lasers operate at optical cavity pressures as low as ten to twenty (10–20) torr. An ejector 14 is utilized to pump the effluent from the optical cavity 12 to an ambient atmosphere, which at sea level is approximately seven hundred sixty (760) torr.

The effluent from the optical cavity is flowable into the ejector 14 through a rectangular shaped duct 16. The effluent is referred to as the driven fluid medium or secondary fluid of the ejector. A high energy fluid of the type producible in a gas generator 18 is flowable through one or more nozzles laterally of the driven fluid medium. The high energy fluid flowable across the nozzles is referred to as the driving fluid medium or primary fluid of the ejector.

In the embodiment illustrated a set of first nozzles 20 are disposed laterally of the duct 16 and a set of second nozzles 22 are disposed laterally of the set of first nozzles. During operation of the ejector, a first portion of the driving medium is discharged from the first set of nozzles at a supersonic velocity greater than the supersonic velocity of the driven medium and at a static pressure above the static pressure of the driven medium. A second portion of the driving medium is discharged from the second set of nozzles at a static pressure above the static pressure of the first driving medium portion. Additional sets of laterally disposed driving medium nozzles may be employed.

In an embodiment employing two sets of laterally staged ejector nozzles across which the effluent from a single gas generator of the nitrogen tetroxide/monomethylhydrazine ($N_2O_4$/MMH) type is discharged, the pressure and velocity conditions of the flow are as follows:

| | Driven Stream | First Stage Driving Stream | Second Stage Driving Stream |
|---|---|---|---|
| Static Pressure | 20 torr | 101 torr | 583 torr |
| Mach Number | 2.0 | 4.32 | 3.17 |

In other embodiments it may be practical to drive the second stage nozzles with effluent from a second gas generator. In such cases it is preferable that the Mach number of the second stage driving stream exceed the Mach number of the first stage driving stream.

The ejector includes a mixing/compression chamber 24 downstream of the driving medium nozzles. The mixing/compression chamber is defined by converging duct walls 26. The duct walls preferably have a fixed geometry with the rate of convergence set to provide a constant static pressure in the driving medium along the duct walls in the operative mode as the driven medium becomes compressed. A throat section 28 is formed downstream of the mixing/compression chamber by only slightly diverging duct walls 30. The cross-sectional area of the throat section is sufficiently large to permit the entry of supersonic flow into the throat section in the operative mode. The length of the throat section is sufficient to permit mixing of the driving and driven mediums and to contain the normal shock train across which the supersonic flow is shocked to subsonic conditions before exiting the throat section. A subsonic diffuser 32 downstream of the throat section is defined between the diverging duct walls 34. The rate of divergence and the length of the duct walls are adequate to provide deceleration of the flow and sufficient pressure recovery in the mixed driven/driving medium to enable discharge of the mixed medium from the diffuser to the ambient atmosphere. The throat section 28 and subsonic diffuser 32 are of conventional design.

Significant pressure recovery in a comparatively short axial length is obtainable in the apparatus described. For a characteristic effluent such as that of a DF laser discharging from a laser cavity at a static pressure of 20 torr and a Mach number of 2.0, recovery to a pressure of 760 torr is expected. Utilizing a gas generator of the nitrogen tetroxide/monomethylhydrazine ($N_2O_4$/MMH) type discharging at a temperature of two thousand degrees Kelvin (2000° K.) with a driving to driven medium mass flow rate of approximately five (5), initial static pressure recovery to approximately one hundred (100) torr is enabled. Such pressure recovery can be achieved in a mixing/compression section 24 as short as forty (40) centimeters for a laser nozzle height of ten (10) centimeters. Essential features of the pressure recovery include the establishment of a multiplicity of weak, oblique shock waves in the driven medium and the control of boundary layer effects at the interface of the driven medium with the driving medium.

Figure 2:
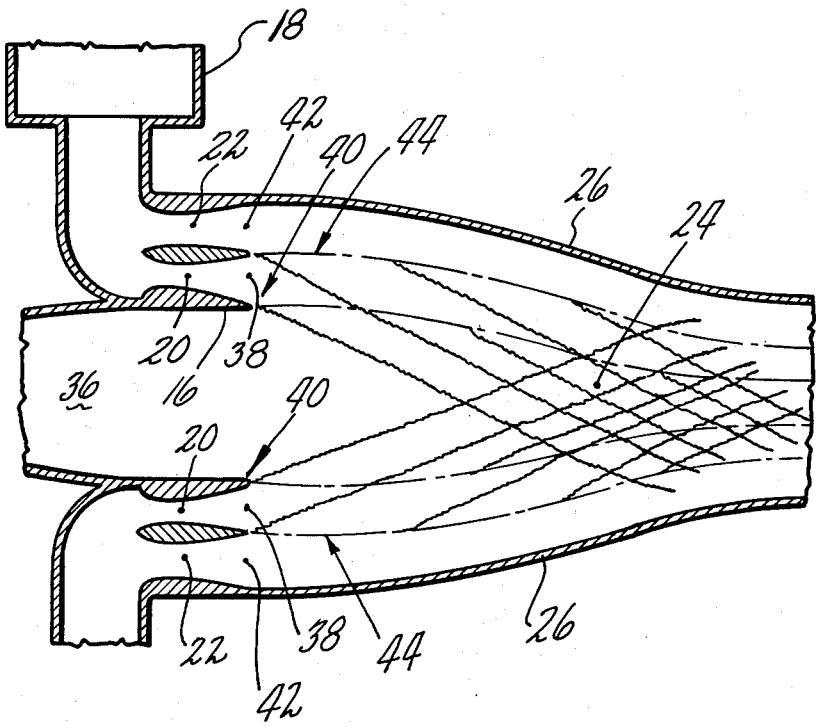
FIG. 2 is an illustration of the flow deflection which results as weak, oblique shock waves are directed across the driven fluid from the interface between driving and driven fluid.

The establishment of the requisite weak, oblique shock waves is illustrated in the FIG. 2 representation of an actual Schlieren photograph. Supersonic driven medium 36 enters the mixing/compression chamber of the ejector through the duct 16. A first portion 38 of the driving medium is directed across the first nozzles 20 and into the chamber at a supersonic velocity greater than the supersonic velocity of the driven medium and at a static pressure above the static pressure of the driven medium.

The difference in static pressure at the interface 40 between driven and driving medium causes a deflection of the interface toward the lower pressure driven medium. Convergence of the duct walls 26 maintains the driving medium at a uniform static pressure therealong with the result that multiple increments of interface deflection occurs until the mediums enter the throat section. Deflection of the interface causes shock waves to emanate from the interface into the driven medium. Small deflections produce weak shock waves traveling at an oblique angle to the approaching flow. Driven medium flowing across each shock wave rises in pressure and decreases in velocity. Flow losses across each shock wave are minor for weak shocks and it is, therefore, preferable to have a large number of weak shocks rather than a lesser number of stronger shocks. The larger the number of weaker shocks, the lower the flow losses become. Higher pressure recovery results.

In the illustrated embodiment a second portion 42 of the driving medium is directed across the second nozzles 22 and into the chamber. The second portion is discharged laterally of and parallel to the first portion at a static pressure above that of the first portion. The difference in static pressure at the interface 44 between the first and second portions of the driving medium causes a deflection of that interface toward the lower pressure portion of the driving medium. Deflection of that interface causes shock waves to emanate therefrom into the driven medium in the same manner that shock waves emanate from the interface between the first portion of the driving medium and the driven medium. The use of multiple banks of laterally staged nozzles increases the number of weak shocks in the driven medium which can be generated practically over a given axial length. The lateral pressure variation produced enables the ejector driving stream to compress the driven stream gradually as the ejector driving the driven stream intermix.

The rate of compression is a function of the angle of flow deflection (δ) across each of the oblique shock waves. Increasing the deflection angle (δ) shortens the length of the device, but also increases the tendency of the flow to separate at the boundary layer between driving and driven streams. In some devices, flow in the boundary layer is turbulent and separation is likely to occur at deflection angles (δ) across the shock waves in excess of thirteen degrees (13°). In other devices, the flow may be laminar and separation is likely to occur at lesser angles. The actual deflection angle within the device is a function of the driving stream Mach number (Mp) and the ratio of driving stream stagnation pressure ($P_{Tp}$) to the driven stream stagnation pressure ($P_{Ts}$). Deflection angles (δ) safely below the angle at which separation is likely to occur are preferred.

Figure 3:
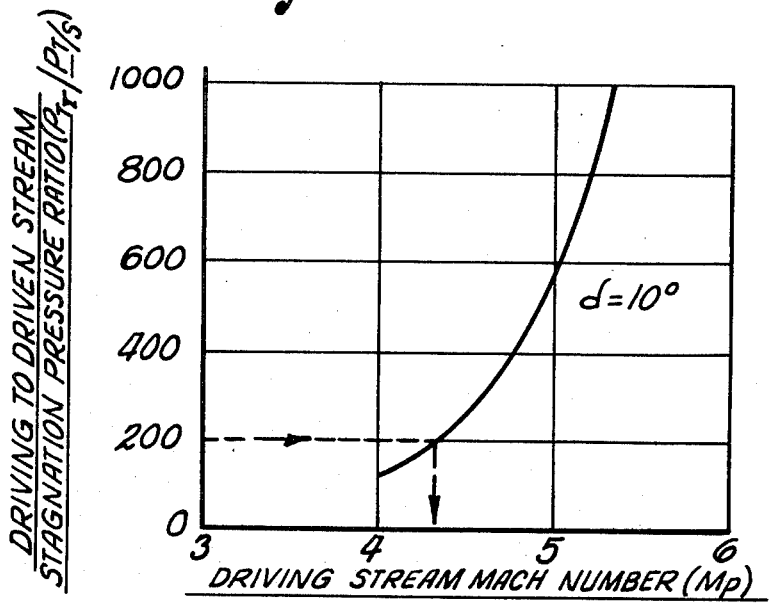
FIG. 3 is a graph relating the first driving stream Mach number (Mp) to the ratio of the stagnation pressures of the first driving stream to the driven stream for a driven stream Mach number (Ms) of two (2) and flow deflection angle (δ) of ten degrees (10°).

A graph relating the deflection angle (δ) to stagnation pressure ratio ($P_{Tp}/P_{Ts}$) and driver stream Mach number (Mp) is represented in FIG. 3 for the particular laser device heretofore described. The driver stream is the effluent from the optical cavity of a deuterium/fluoride (DF) laser and the driving stream is the effluent from a nitrogen tetroxide/monomethylhydrazine ($N_2O_4$/MMH) gas generator. Stream characteristics are described below:

| | Laser (DF) | Gas Generator ($N_2O_4$/MMH) |
|---|---|---|
| Mach Number | 2.0 | (FIG. 3) |

-continued

| | Laser (DF) | Gas Generator ($N_2O_4$/MMH) |
|---|---|---|
| Stagnation Pressure | 0.2 Atms. | 40 Atms. |
| Specific Heat Ratio | 1.58 | 1.32 |

Under most conditions in this device, a deflection angle (δ) across the shock waves of ten degrees (10°) is unlikely to cause significant flow separation and may be selected for operation of the device. Accordingly, the first set of driving fluid nozzles at a stagnation pressure ratio of two hundred (200) must be capable of accelerating the driving fluid to a Mach number of 4.32 for that condition of operation.

In laterally staged embodiments employing additional driving stages, the velocity levels of the additional driving mediums is selected by the above criteria, replacing the driven stream conditions (Mach number, stagnation pressure, flow turning angle) with those of the more inward driving stream. For the above-described embodiment, in which the first driving stream Mach number selected in accordance with the FIG. 3 graph is four and thirty-two hundredths (4.32), the second driving stream Mach number is selected from the FIG. 4 graph. The stagnation pressure ratio for first and second driving streams emanating from a single gas generator is, of course, one (1). The selected Mach number of the second driving stream is three and seventeen hundredths (3.17).

Figure 4:
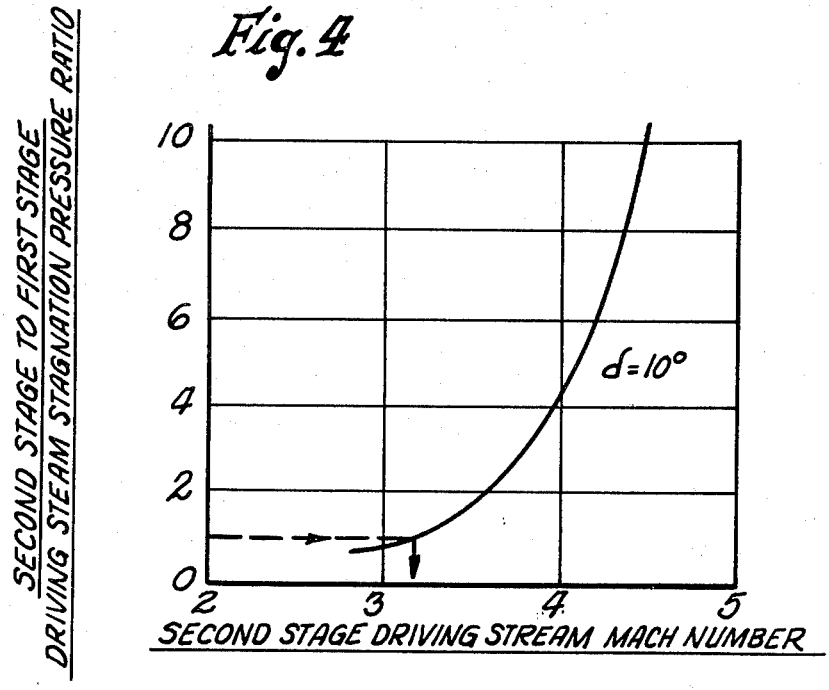
FIG. 4 is a graph relating the Mach number of a second laterally staged driving medium stream to the ratio of the stagnation pressures of the second and first laterally staged driving medium streams for a first stream Mach number of four and thirty-two hundredths (4.32) and flow deflection angle (δ) of ten degrees (10°).

Graphs comparable to those displayed in FIGS. 3 and 4 are derivable for other driving streams and for other deflection angles which are utilized in any specific device.

Although the invention has been shown and described with respect to preferred embodiments thereof, it should be understood by those skilled in the art that various changes and omissions in the form and detail thereof may be made therein without departing from the spirit and scope of the invention.

I claim:

1. In an ejector of the type for pumping a supersonic velocity, ejector driven medium to a higher pressure, the improvement comprising:

means for generating a multiplicity of weak shock waves extending into the driven medium at an acute angle to the direction of flow for compressing the driven medium at supersonic velocities including at least one first driving medium nozzle capable of discharging an ejector driving medium laterally of and parallel to the driven medium at a supersonic velocity greater than the supersonic velocity of the driven medium and at a static pressure above the static pressure of the driven medium.

2. The invention according to claim 1 wherein the ejector has a rectangular inlet through which the driven medium is flowable into the ejector and wherein the ejector has a pair of said first driving medium nozzles positioned one each on opposing sides of said rectangular inlet.

3. The invention according to claim 2 which further has means for discharging additional driving medium, laterally of and parallel to the driving medium dischargeable from said first driving medium nozzles, at a static pressure above said driving medium dischargeable from the first driving medium nozzles to generate additional weak shock waves across said driven medium for further compression of the driven medium.

4. A method for pumping a first supersonic fluid medium to a higher pressure at supersonic velocities which includes the step of flowing a second supersonic fluid medium laterally of and parallel to said supersonic fluid medium at a velocity greater than the velocity of said first supersonic fluid medium and at a pressure above the pressure of said first supersonic fluid medium to cause weak, oblique shock waves to emanate from the interface between the fluid mediums and into the first supersonic fluid medium for compressing said first supersonic fluid medium.

* * * * *